US005551171A

United States Patent [19]

Dahl

[11] Patent Number: 5,551,171

[45] Date of Patent: Sep. 3, 1996

[54] WINDING DEVICE FOR A FIBER WEB

[75] Inventor: Hans Dahl, Ravensburg, Germany

[73] Assignee: Sulzer-Escher Wyss GmbH, Ravensburg, Germany

[21] Appl. No.: 290,283

[22] Filed: Aug. 15, 1994

[30] Foreign Application Priority Data

Aug. 23, 1993 [DE] Germany ..... 43 28 310.1

[51] Int. Cl.[6] ..... F26B 13/00

[52] U.S. Cl. ..... 34/625

[58] Field of Search ..... 34/625

[56] References Cited

U.S. PATENT DOCUMENTS

| | | | |
|---|---|---|---|
| 1,585,977 | 5/1926 | Hall . | |
| 2,020,118 | 11/1935 | Kellet et al. | 242/65 |
| 3,515,183 | 6/1970 | Voss | 242/66 |
| 3,675,868 | 7/1972 | Piattelli | 242/67.1 |
| 4,429,819 | 2/1984 | Palovaara | 226/95 |
| 4,593,480 | 6/1986 | Mair et al. | 34/625 |
| 4,677,763 | 7/1987 | Kotitschke et al. | 34/116 |
| 4,698,918 | 10/1987 | Kotitschke et al. | 34/116 |

FOREIGN PATENT DOCUMENTS

| | | |
|---|---|---|
| 1243197 | 10/1988 | Canada . |
| 2007211 | 1/1970 | France . |
| 2721881 | 11/1978 | Germany . |
| 3015547 | 10/1981 | Germany . |
| 3400939 | 8/1984 | Germany . |
| 3321213 | 12/1984 | Germany . |
| 3344217 | 6/1985 | Germany . |
| 9208419 | 9/1992 | Germany . |
| 4140963 | 11/1992 | Germany . |
| 9305752 | 12/1993 | Germany . |
| 2226304 | 6/1990 | United Kingdom . |

*Primary Examiner*—John T. Kwon
*Attorney, Agent, or Firm*—Greenblum & Bernstein P.L.C.

[57] ABSTRACT

The invention pertains to a winding device for a fiber web having a carrier drum that is at least partially enveloped by the fiber web, wherein a carrier axis for the fiber web is adapted to fed or moved to the carrier drum and is adapted to contact the carrier drum jacket in an axially parallel winding position, with the goal being to further develop winding devices which limit the danger of web tearing and act against the formation of folds in the fiber webs, with this being achieved in that the fiber web is transferred, from a device, which device precedes the carrier drum in the web moving direction, together with a driving band, to the carrier drum and transferred there from the driving band to the carrier drum.

22 Claims, 1 Drawing Sheet

WINDING DEVICE FOR A FIBER WEB

BACKGROUND OF THE INVENTION

1. Field of the Invention

The invention pertains to a winding device for a fiber web having a carrier drum that is at least partially enveloped by the fiber web, wherein a carrier axis for the fiber web is adapted to fed or moved to the carrier drum and is adapted to contact the carrier drum jacket in an axially parallel winding position.

2. Discussion of the Background of the Invention and Material Information

Such winding devices are known, for example, in German Patent Publication No. DE-PS 30 15 547 as well as German Patent Publication No. DE-PS 33 21 213 and consist mainly of a carrier drum, wherein a carrier axis or windup unit is adapted to be moved thereto via a conveying apparatus and is adapted to contact the drum jacket in an axially parallel winding position. In addition, a pivot unit serves for the subsequent pivoting of the carrier axis in the direction away from (outlet side) of the side of the incoming web, into a winding position and a roller conveyor serves for carrying and guiding the carrier axis during the winding procedure and the rolling away of the finished package from the winding position.

It is a disadvantage that the generally desired speed increase in the winding procedure also leads to an increase in the danger of web tear. In addition, shrinkage, air pumping at the carrier drum and formation of wrinkles limit the quality of the winding.

SUMMARY OF THE INVENTION

The goal or object of this invention is to further develop winding devices of the previously noted type which limit the danger of web tearing and act against the formation of folds in the fiber webs.

This object is accomplished in one embodiment of this invention by means of a winding device for a fiber web including a carrier drum, wherein the fiber web is at least partially wrapped around the carrier drum, a carrier axis for the fiber web adapted to be moved to the carrier drum and adapted to contact a jacket of the carrier drum in an axially parallel winding portion wherein the fiber web is transferred, from a device, which device precedes the carrier drum in the web moving direction, together with a driving band, to the carrier drum and transferred from the driving band to the carrier drum.

In a further embodiment of the winding device of this invention, the preceding unit is a dryer unit for the fiber web and a drying sieve, utilized in the dryer unit is, at the same time, used as the driving band.

In another embodiment of the winding device of this invention, the preceding unit is a finishing unit for the fiber web and the driving band receives the fiber web substantially directly at the finishing unit.

In an additional embodiment of the winding device of this invention, the carrier drum includes suction zones for enhancing the acceptance of the fiber web.

In still a further embodiment of the winding device of this invention, the suction zones are predominately arranged at the edge region of the carrier drum.

In yet another embodiment of the winding device of this invention, the suction devices are provided along the running extent of the driving band for the fixation of the fiber web onto the driving band.

In still a different embodiment of the winding device of this invention, the suction device takes the form of suction control rolls for sieve guiding purposes.

Since the fiber web is guided together with a guiding/driving sieve/band or a similar applicable band to, and is received by, the carrier drum in the web moving direction via a device or apparatus that precedes or is a lead-in unit to the carrier drum, it is possible to minimize or eliminate the open draw of the fiber web in this region. The result is a fixation of the fiber web at the driving band thereby acting against shrinkage and tearing.

If the preceding or lead-in device is a drying unit it is, among other things, advantageous, in terms of reducing expenses, to convey out the dry sieve used in this device and utilize it also as the driving band for the fiber web.

In the case of the device is a finishing unit, it is recommended, in order to reduce the open draw of the fiber web, to guide or direct the separate guide sieve as closely as possible onto the finishing unit.

In order to enhance the acceptance of the guiding sieve onto the carrier drum, the latter preferably includes suction zones in the transfer region. The arrangement of suction zones in the edge region enhances the lead-in or reception of the fiber web, that is, the edge strips thereof.

In order that the fiber web becomes sufficiently affixed to the guide sieve, suction devices, in the form of suction boxes or suction control rolls, should be provided. These suction devices preferably include edge suction zones for the lead-in of the fiber web.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
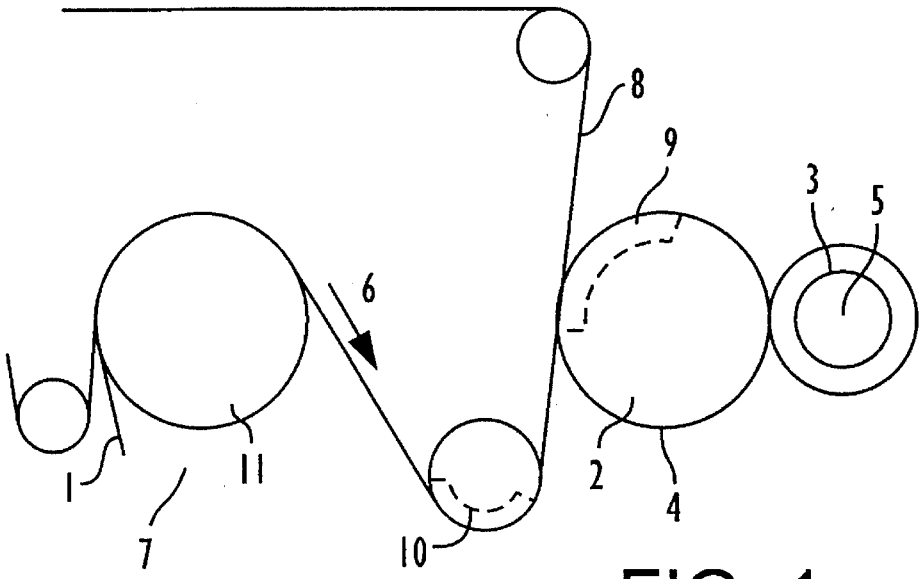
FIG. 1 is a schematic representation of the winding device that is preceded by a drying unit.

The embodiment illustrated in FIG. 1 pertains to a winding device that is preceded, in a web moving direction 6, by a dryer unit 7, which is comprised mainly of drying cylinders 11 and sieve, screen or felt bands which lead or convey and press a fiber web 1 onto the drying cylinders. This dryer unit 7 can, for example, take the form of a dual pull drying unit of the type disclosed in German Patent Publication No. DE-Gbm 93 05 752.0. The upper screen or felt band leaves the dryer unit 7 and is conveyed or directed, while also functioning as a carrier or driving band, together with fiber web 1 onto the carrier drum 2 of the winding device. Upon the acceptance of the fiber web 1 by the carrier 2, the carrier band 8 is again returned to the dryer unit 7. In order to assure, during the transporting of fiber web 1 to carrier drum 2, the retention of fiber web 1 relative to carrier band 8, differing suction devices 10 can be utilized. In FIG. 1 this is accomplished via a suction control roll which, at the same time, serves to guide the sieve or screen.

Figure 2:
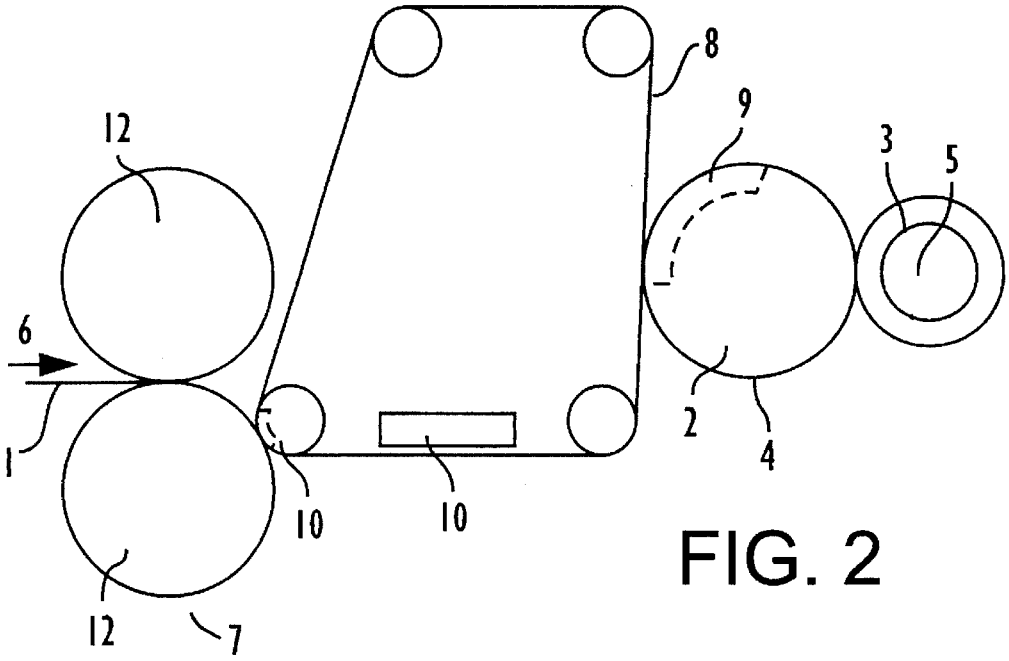
FIG. 2 is a schematic representation of the winding device precede by a finishing unit.

FIG. 2 shows, as the preceding or lead-in unit 7, a finishing unit which generally is comprised of two wedge-forming rollers 12, through which fiber web 1 is guided for the finishing operation and an example of which is disclosed in German Patent Publication No. DE-OS 41 40 963. Herein the carrier or driving screen, band or sieve 8 is separately arranged and conveyed over several control rolls. In order to prohibit an open draw of fiber web 1, a suction control roll receives fiber web 1 directly at one of rollers 12. The further guidance of fiber web 1 then occurs analogous to that of the FIG. 1 embodiment until the transfer to carrier drum 2, where here an additional suction box is utilized in order to adhere fiber web 1 onto driving band 8.

In both instances, the takeover or acceptance of fiber web 1 from driving band 8 onto carrier drum 2 occurs with the assistance of suction zones 9 of carrier drum 2, with the suction zones predominately being provided at the edge and transfer regions thereof. At the same time, the carrier drum 2, provided with drum jacket 4, can also be wrapped or enveloped by driving band 8. Thereafter, fiber web 1, is rolled up on carrier axis or windup unit 3 in a windup position 5.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A winding device for a fiber web including a carrier drum, wherein the fiber web is at least partially wrapped around the carrier drum, a carrier axis for the fiber web adapted to be moved to the carrier drum and adapted to contact a jacket of the carrier drum in an axially parallel winding portion wherein the fiber web is transferred, from a dryer unit for the fiber web, which dryer unit precedes the carrier drum in the web moving direction, together with a driving band, to the carrier drum and transferred from the driving band to the carrier drum; and wherein a drying sieve, utilized in the dryer unit is, at the same time, used as the driving band.

2. The winding device of claim 1, wherein the carrier drum includes suction zones for enhancing the acceptance of the fiber web.

3. The winding device of claim 2, wherein the suction zones are predominately arranged at edge regions of the carrier drum.

4. The winding device of claim 2, wherein suction devices are provided along the running extent of the driving band for the fixation of the fiber web onto the driving band.

5. The winding device of claim 4, wherein the suction devices take the form of suction control rolls for sieve guiding purposes.

6. The winding device of claim 1, wherein suction devices are provided along the running extent of the driving band for the fixation of the fiber web onto the driving band.

7. The winding device of claim 6, wherein the suction devices take the form of suction control rolls for sieve guiding purposes.

8. A winding device for a fiber web including a carrier drum, wherein the fiber web is at least partially wrapped around the carrier drum, a carrier axis for the fiber web adapted to be moved to the carrier drum and adapted to contact a jacket of the carrier drum in an axially parallel winding portion wherein the fiber web is transferred, from a finishing unit for the fiber web, which finishing unit precedes the carrier drum in the web moving direction, together with a driving band, to the carrier drum and transferred from the driving band to the carrier drum; and wherein the driving band receives the fiber web substantially directly at the finishing unit.

9. The winding device of claim 8, wherein the carrier drum includes suction zones for enhancing the acceptance of the fiber web.

10. The winding device of claim 9, wherein the suction zones are predominately arranged at edge regions of the carrier drum.

11. The winding device of claim 9, wherein suction devices are provided along the running extent of the driving band for the fixation of the fiber web onto the driving band.

12. The winding device of claim 11, wherein the suction devices take the form of suction control rolls for sieve guiding purposes.

13. The winding device of claim 8, wherein suction devices are provided along the running extent of the driving band for the fixation of the fiber web onto the driving band.

14. The winding device of claim 13, wherein the suction devices take the form of suction control rolls for sieve guiding purposes.

15. A winding device for a fiber web including a carrier drum, wherein the fiber web is at least partially wrapped around the carrier drum, a carrier axis for the fiber web adapted to be moved to the carrier drum and adapted to contact a jacket of the carrier drum in an axially parallel winding portion wherein the fiber web is transferred, from a device, which device precedes the carrier drum in the web moving direction, together with a driving band, to the carrier drum and transferred from the driving band to the carrier drum; and wherein the carrier drum includes suction zones for enhancing the acceptance of the fiber web.

16. The winding device of claim 15, wherein the suction zones are predominately arranged at edge regions of the carrier drum.

17. The winding device of claim 16, wherein suction devices are provided along the running extent of the driving band for the fixation of the fiber web onto the driving band.

18. The winding device of claim 17, wherein the suction devices take the form of suction control rolls for sieve guiding purposes.

19. The winding device of claim 15, wherein suction devices are provided along the running extent of the driving band for the fixation of the fiber web onto the driving band.

20. The winding device of claim 19, wherein the suction devices take the form of suction control rolls for sieve guiding purposes.

21. The winding device for a fiber web including a carrier drum, wherein the fiber web is at least partially wrapped around the carrier drum, a carrier axis for the fiber web adapted to be moved to the carrier drum and adapted to contact a jacket of the carrier drum in an axially parallel winding portion wherein the fiber web is transferred, from a device, which device precedes the carrier drum in the web moving direction, together with a driving band, to the carrier drum and transferred from the driving band to the carrier drum, wherein suction devices are provided along the running extent of the driving band for the fixation of the fiber web onto the driving band.

22. The winding device of claim 21, wherein the suction device takes the form of suction control rolls for sieve guiding purposes.

* * * * *